US008875608B2

(12) United States Patent
Lewalski et al.

(10) Patent No.: US 8,875,608 B2
(45) Date of Patent: Nov. 4, 2014

(54) SHEET SLITTING MECHANISM WITH AUTOMATED SIZE ADJUSTMENT

(75) Inventors: Steven P. Lewalski, Melrose, MA (US); Bruce J. Taylor, Manchester, NH (US)

(73) Assignee: Lasermax Roll Systems, Inc., Billerica, MA (US)

( * ) Notice: Subject to any disclaimer, the term of this patent is extended or adjusted under 35 U.S.C. 154(b) by 215 days.

(21) Appl. No.: 13/291,062

(22) Filed: Nov. 7, 2011

(65) Prior Publication Data

US 2013/0112055 A1 May 9, 2013

(51) Int. Cl.

| | |
|---|---|
| ***B26D 7/06*** | (2006.01) |
| ***B26D 5/00*** | (2006.01) |
| ***B26D 1/14*** | (2006.01) |
| ***B26D 1/24*** | (2006.01) |
| ***B26D 7/26*** | (2006.01) |

(52) U.S. Cl.

CPC ..... *B26D 7/2635* (2013.01); *B26D 7/2628* (2013.01); *B26D 2007/2657* (2013.01)

USPC ..... 83/13; 83/404; 83/482; 83/499; 83/404.1

(58) Field of Classification Search

USPC ..... 83/404.1, 404.3, 499–503, 504, 506, 83/497, 507, 508.1–508.3, 481–483, 448, 83/829, 934

See application file for complete search history.

(56) References Cited

U.S. PATENT DOCUMENTS

| | | | | |
|---|---|---|---|---|
| 4,026,176 | A * | 5/1977 | Weiskopf | 83/502 |
| 4,033,217 | A * | 7/1977 | Flaum et al. | 83/425.4 |
| 4,220,064 | A * | 9/1980 | Potter | 83/665 |
| 4,252,044 | A * | 2/1981 | Yamashita et al. | 83/499 |
| 4,269,097 | A * | 5/1981 | Linn | 83/482 |
| 4,781,668 | A * | 11/1988 | Mowry | 493/365 |
| 4,962,684 | A * | 10/1990 | Mowry | 83/332 |
| 5,074,180 | A * | 12/1991 | Mayer et al. | 83/698.42 |
| 5,099,734 | A * | 3/1992 | Sugiyama et al. | 83/498 |
| 5,297,464 | A * | 3/1994 | Mayer | 83/499 |
| 5,316,109 | A * | 5/1994 | Thomas et al. | 188/41 |
| 5,378,221 | A * | 1/1995 | Lauderbaugh et al. | 493/367 |
| 5,937,722 | A * | 8/1999 | Albright | 83/498 |
| 6,565,499 | B2 * | 5/2003 | Benzoni | 493/199 |
| 6,732,625 | B1 * | 5/2004 | Boynton et al. | 83/482 |
| 7,134,372 | B2 * | 11/2006 | Flaherty et al. | 83/425.4 |
| 7,690,882 | B1 * | 4/2010 | Sjostedt et al. | 414/763 |
| 8,047,110 | B2 * | 11/2011 | Pappas et al. | 83/481 |
| 2011/0049781 | A1 | 3/2011 | Lewalski et al. | |

FOREIGN PATENT DOCUMENTS

| | | |
|---|---|---|
| EP | 1279453 A2 | 1/2003 |

* cited by examiner

*Primary Examiner* — Ghassem Alie
*Assistant Examiner* — Bharat C Patel
(74) *Attorney, Agent, or Firm* — Loginov & Associates, PLLC; William A. Loginov

(57) ABSTRACT

This invention provides a slitter assembly with automated adjustment of slitter elements that allows for driven rotation of elements on the associated drive shaft during operation while enabling the elements to be moved freely along the drive shaft during setup and subsequently secured to the shaft free of lateral movement. This ensures that adjustment of the slitter elements is accurate, repeatable and reliable. In an illustrative embodiment, the slitter elements each comprise a pair of coaxial members including a blade member and a locking member. The blade member contains a slitter blade and overlies the locking member which is nested therewith. The locking member directly engages the drive shaft surface with a wedge assembly structure. The members are spring-loaded with respect to each other so that the two surfaces are normally biased to cam together and exert a hoop stress on the drive shaft.

12 Claims, 12 Drawing Sheets

SHEET SLITTING MECHANISM WITH AUTOMATED SIZE ADJUSTMENT

FIELD OF THE INVENTION

This invention relates to web and sheet cutting and slitting mechanisms, and more particularly to slitters with slitting elements that are adjustable in relative spacing to provide slit sheets of a desired width.

BACKGROUND OF THE INVENTION

The creation of finished, bound books using "print on-demand" processes and electronic print engines is becoming ever more popular for publishers of all sizes. Unlike traditional printing processes, which employ fixed plate presses to transfer images to the web or sheet, electronic printing allows for the creation of smaller print runs that can be customized, on a book by book basis. To maximize efficiency, pages for finished books are often printed on a larger overall web or sheet, which is subsequently cut and slit into the desired page dimensions. These cut pages are thereafter fed to a collection point and stacked into finished "book blocks." The book blocks are trimmed into squared-off stacks using a three-knife trimmer, and directed to a binding process, wherein an outer cover is bound to the book page stack.

The creation of book blocks often involves a number of manual steps. For example, printers often generate a plurality of page images on a larger sheet (sized 11×17 inch, for example). These images must be separated into separate pages of appropriate size. The manipulating of sheets from the printer can entail forming secondary stacks and thereafter physically moving and directing the stacks through cutters and slitters to generate the final set of pages in the appropriate page order. This book block stack is then directed to the trimming and binding process by another set of manual tasks. Any defective pages or stacks are removed and dealt with by hand, typically requiring the reassembly of the defective stack with new replacement pages as appropriate.

Currently available electronic printers, such as the Indigo™ 5500 Digital Press, available from the Hewlett-Packard Company of Palo Alto, Calif., offer a wide range of print versatility at high levels of print quality. Such printers allow for the duplex (two-sided) printing of full color photo-quality images on a variety of paper types (matte, glossy, etc.), fed from sheets. These printers, and other of similar type, offer a high throughput speed (for example, currently up to approximately 70 pages per minute (ppm) for color print and up to approximately 270 ppm for monochrome print). Completed sheets, typically containing multiple, two-sided page images in appropriate sizes are stacked on an output stack that is subsequently divided into appropriate pages for binding in a finished book. A printing computer and associated software application(s), which interconnected with the print engine controller, organizes the order and location of images on each side of each sheet.

To fully take advantage of the speed and versatility of such electronic printers, the automation of the handling of output sheets is highly desirable. In general, it is desirable that the output sheets be automatically cut and slit to appropriate sizes and that this sizing process allow for the creation of accurate, full-bleed (e.g. marginless) pages that are ready to stack into completed books. The slitter arrangement is a significant element in the sizing of sheets. A common form of slitter provides a pair of rotating wheels that overlap in an impinging manner to form a scissor or shear surface. At the sheet is directed between these slitter wheels, it is cut along the upstream-to-downstream feed direction, thereby removing edge gutters and establishing a width dimension for the sheet. Slitters can be placed to provide inboard slits to the sheet that create a plurality of side-by-side sheets, each of a predetermined with. The widthwise dimension of the sheet is directly related to the lateral (widthwise) spacing between each pair of impinging slitter elements (wheels) and an adjacent pair of impinging slitter elements.

During setup, before a print job begins, slitter elements are typically moved along their associated drive shaft by hand to an appropriate location and then fixed in a position on the shaft using a set screw, clamp or other fastening mechanism that is manually secured. The placement of the slitter elements along the shaft (and resulting page width) is largely dependent on the operator's accuracy in setting up the slitter assembly. This requires time and may entail a plurality of test runs before the slitter is ready for runtime use. Automation of the positioning of slitter elements is somewhat challenging. The elements should be positively secured once they are in a desired position on the shaft, but should be free to move along the shaft during the adjustment process. Likewise, not all the slitter elements may be desired for a particular job, and the unused elements should be movable to a position where they do not interfere with the paper/sheet path. Moreover, the elements must be free to rotate during operation. These challenges can render ineffective certain types of adjustment mechanisms, such as a lead-screw that continually engages the slitter elements.

It is therefore desirable to provide a slitter adjustment mechanism that allows for free rotation of the slitter elements on their shaft, allows unused elements to be moved out of the paper/sheet path and that accurately adjusts the slitter elements to a desired position within the overall slitter assembly substantially free of manual contact by the operator.

SUMMARY OF THE INVENTION

This invention overcomes disadvantages of the prior art by providing a slitter assembly with automated adjustment of slitter elements that allows for driven rotation of elements on the associated drive shaft during operation while enabling the elements to be moved freely (axially) along the drive shaft during setup and subsequently secured to the shaft in a manner that is free of lateral movement. This ensures that adjustment of the slitter elements is accurate, repeatable and reliable. In an illustrative embodiment, the slitter elements each comprise a pair of coaxial members including a blade member and a locking member. The blade member contains a slitter blade and overlies the locking member which is nested therewith. The locking member directly engages the drive shaft surface with a wedge assembly structure defining a relatively thin wall separated by a plurality of splits or slots. The splits or slots allow for flexure. The outer surface of the wedge assembly structure is frustoconical and mates with a frustoconical inner surface on the locking member. The members are spring-loaded with respect to each other so that the two surfaces are normally biased to cam together and exert a hoop stress on the drive shaft surface. This maintains a secure engagement between the slitter element and the drive shaft. The hoop stress is relieved, and the slitter element can be relocated along the shaft when a key on a moving carriage (a key assembly) is temporarily inserted between the blade member and the locking member, thereby overcoming the spring force and un-camming the wedge assembly. The carriage then moves the engaged slitter element to a new location according to a programmed position. In general, two impinging slitter elements are provided in a stacked arrangement, with the key releasably engaging and moving both simultaneously so that the pair of impinging slitter elements is moved along the shaft to a new location as a unit.

In an illustrative embodiment, each key carriage is provided on a track that allows the carriage to move laterally along the slitter assembly. The carriage is moved by a belt or lead screw drive under control of a servo, stepper or other appropriate drive motor. The slitter assembly can comprise a removable cartridge that includes detachable electrical connections between the carriage and the underlying feed unit. The carriage can be removed from and replaced within the paper/sheet feed path as appropriate. The slitter assembly/cartridge also includes a plurality of lateral guide rails on the upstream side of the assembly that slidably support movable blocks. The blocks contain downstream-directed feed guides that funnel sheets into the adjacent slitter elements. The blocks include grooves that are selectively engaged by the key when it is directed into the slitter elements to release them. Thus, when the key and carriage move the slitter elements laterally along the shaft it simultaneously moves the feed guides to maintain the guides in lateral alignment with the slitter elements. This ensures that the slit portion of each sheet is properly presented to the impingement point of the slitter blades.

In another illustrative embodiment, a method for adjustably slitting sheets includes the steps of initially locating a plurality of slitter element pairs on drive shafts in a first adjustment position. At least one of the slitter element pairs is engaged with a key assembly. While engaged and unlocked, at least one of the slitter element pairs is moved to a location on the drive shafts defining a second adjustment position. The key assembly is then disengaged from at least one of the slitter element pairs to lock the at least one of the slitter element pairs in the second adjustment position. A sheet guide assembly located adjacent to the at least one of the slitter element pairs is also engaged with the key assembly and, while engaged, the sheet guide assembly is moved in conjunction with at least one of the slitter element pairs

BRIEF DESCRIPTION OF THE DRAWINGS

The invention description below refers to the accompanying drawings, of which.

DETAILED DESCRIPTION

Figure 1:
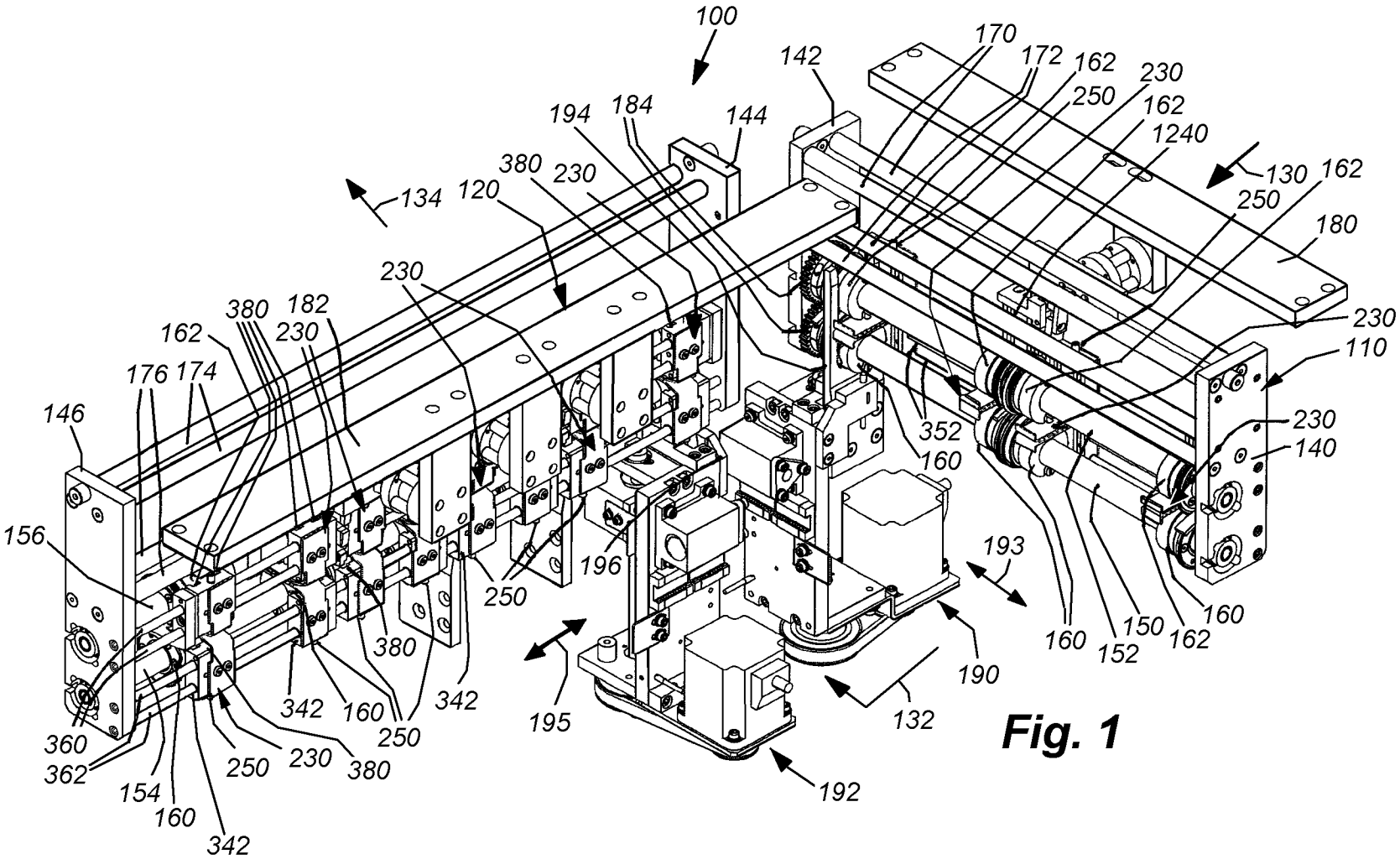
FIG. 1 is a perspective view of a plurality of illustrative slitter assemblies in the form of replaceable slitter cartridges that are arranged by way of example at right angles to provide cross-slit sheets.
Figure 2:
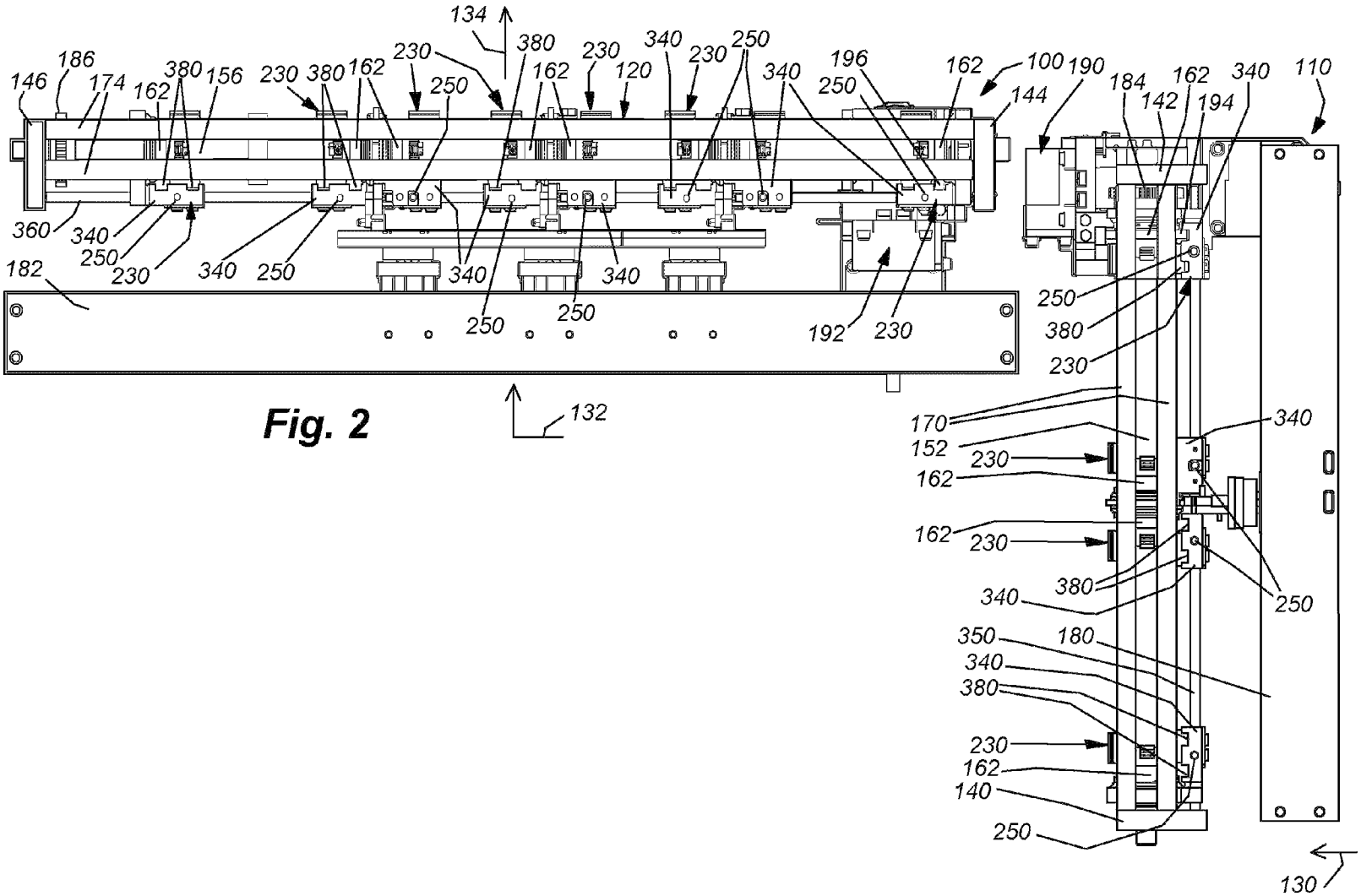
FIG. 2 is a top view of the exemplary arrangement of slitter assemblies of FIG. 1.
Figure 3:
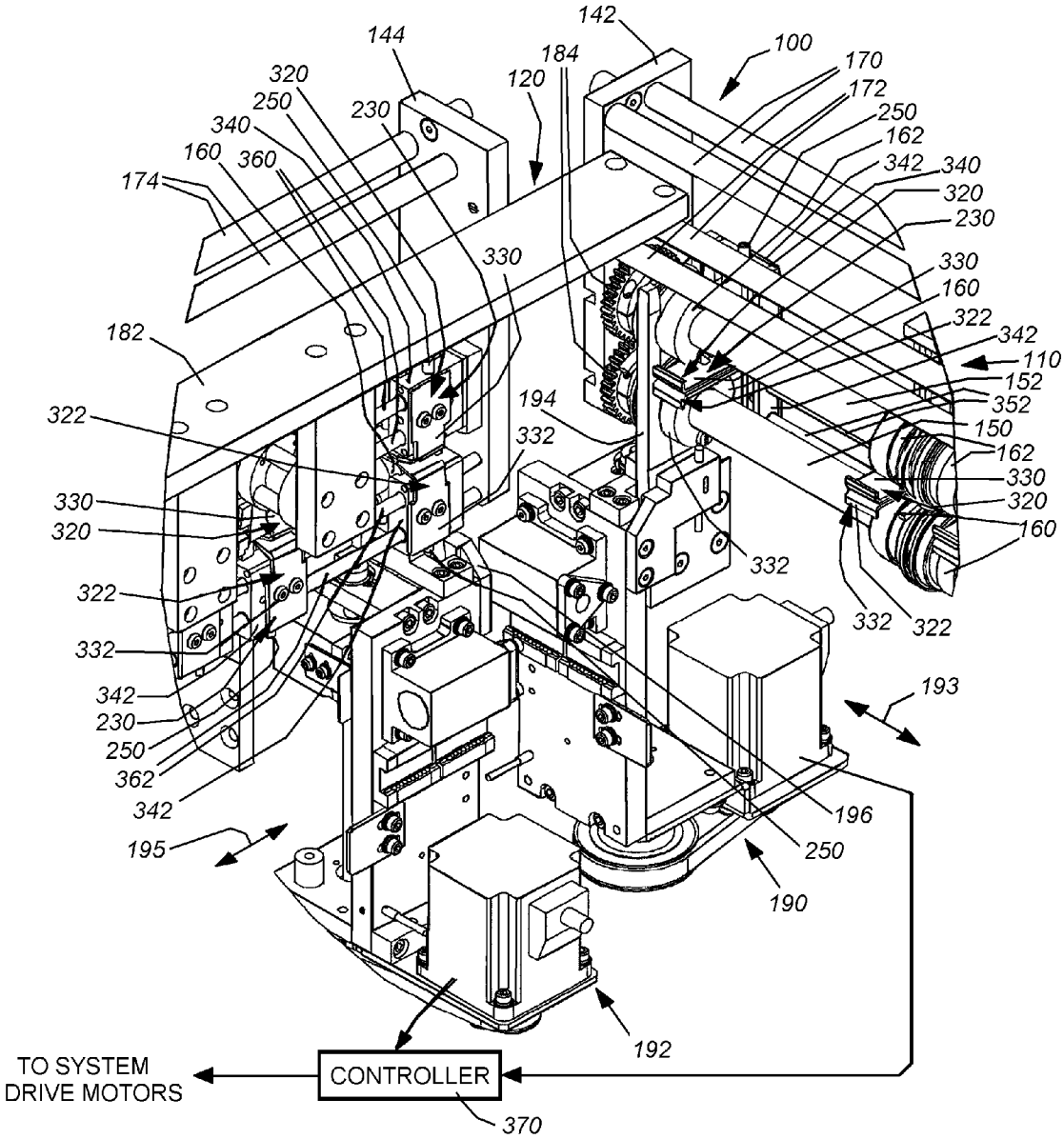
FIG. 3 is a fragmentary perspective view of the illustrative moving key assemblies and associated carriages with respect to each of the slitter assemblies of FIG. 1.

FIGS. 1-3 show an arrangement 100 of slitter assemblies 110 and 120 for use in a sheet feeding device, the details of which have been omitted for clarity. In general, either, or both of, the slitter assemblies 110 and 120 can be provided in an appropriate sheet-feeding device or arrangement according to illustrative embodiments herein. The depicted, exemplary right-angle arrangement is employed in conjunction with a right-angle turn (bump turn) module in which sheets (not shown) enter (arrow 130) the upstream slitter assembly 110, and are separated into a pair (or more) of side-by side sheets. These sheets are then directed (by appropriate drive elements) at a substantially 90-degree angle (right-angled arrow 132) into the downstream slitter assembly 120. Each side-by-side sheet is, in turn slit into a plurality of smaller side-by-side sheets that are driven (arrow 134) downstream for merging, stacking and further processing (e.g. binding). The exemplary, downstream slitter assembly 120 is arranged to produce four side-by-side sheets from each of the upstream slit sheets. Thus a total of eight sheets (pages) are generated from an original input sheet. This can be termed an eight-up configuration. Of course this arrangement is only by way of example of a variety of configurations. By way of further useful background information, a right-angle slitter arrangement as described herein, for use in a book-stack production system, is shown and described in commonly-assigned US Published Patent Application No. US 2011/0049781 A1, entitled SYSTEM AND METHOD FOR INLINE CUTTING AND STACKING OF SHEETS FOR FORMATION OF BOOKS, by Steven P. Lewalski and Hans Eliasson, the teachings of which are expressly incorporated herein by reference. This exemplary system is only one of a variety of arrangements that can benefit by the illustrative embodiments described herein.

Each slitter assembly 110, 120 is in the form of a removable cartridge in an illustrative embodiment, constructed with a self-contained framework having a pair of opposing side plates 140 and 142 (for upstream assembly 110), and 144 and 146 (for downstream assembly 120). The side plates rotatably support a pair of parallel drive shafts 150 and 152 (for upstream assembly 110), and 154 and 156 (for downstream assembly 120). The drive shafts each rotatably support a plurality of lower and upper slitter elements 160 and 162, respectively. In this embodiment, the lower slitter elements 160 define a blade geometry that forms a shear surface with respect to the blade geometry of the upper slitter elements when the blade portions overlap as shown. The blade portions of the slitter elements 160, 162 can define a conventional shape or a modified shape as appropriate.

The side plates (140, 142) and (144, 146) are held in place by a plurality of horizontal rails (170, 172) and (174, 176), respectively. These rails are illustrative of a variety of supporting arrangements. They allow each slitter assembly 110 and 120 to be a self-contained unit that can act as a removable cartridge in an overall sheet transport device, such as that shown and described in the above-incorporated US Published Patent Application No. US 2011/0049781 A1. In this manner, a cartridge can be removed for service, or to be substituted with another cartridge having a different arrangement of slitters and associated components (or a cartridge with no slitters where sheets are to be directed through the unit free of slitting). Note various supporting members have been omitted from FIGS. 1-3 for clarity of the operating components. Each slitter assembly/cartridge 110, 120 includes, among other components a top plate 180 and 182, respectively that supports components of the slitter assembly. The drive shafts (150, 152) and (154, 156) in each assembly 110, 120 rotated together by a pair of gears 184 and 186, respectively, positioned adjacent an end plate 142 and 146, respectively. The gears cause the shafts to rotate together and removably mesh with a drive gear of a drive motor assembly within the transport unit (not shown). The drive motor assembly can be any acceptable drive arrangement, such as a stepper or servo motor and an associated power transmission assembly.

Each slitter assembly/cartridge 110, 120 is served by an integral key assembly 190 and 192, respectively. The key assembly defines a moving carriage structure that is constructed and arranged to selectively and vertically drive a fork-shaped key 194 and 196, respectively, into and out of engagement with the slitter elements 160 and 162 when they are stacked together as shown to form a shearing (impingement) surface. As shown, the key 194 is extended into an engaged with the slitter elements and the key 196 is retracted/withdrawn into a disengaged position. The keys 194, 196 selectively lock and unlock the slitter elements with respect to the drive shaft. When locked, by removal of the key, the slitter elements (160, 162) are essentially fixed to the shaft, both laterally (axially) and rotatably. When unlocked, by engaging the key with the slitter elements, the slitter elements can be moved laterally (axially) along the shaft (double arrows 193 and 195) to a desired location along its elongated length between the end plates. This allows the key assembly 190, 192 to shuttle along the shaft, selectively engaging and disengaging various pairs of slitter elements (that together form a shear surface), and place each pair of slitter elements at a desired location. This location can be a slitting position with respect to a sheet of a predetermined size, or the location can be outside the width of the feed path so that a particular pair of slitter elements is rendered inactive for that job. The internal mechanism that enables locking and unlocking of slitter elements is described further below.

In order to ensure that sheets are positively guided into the shear surface formed between each pair of active slitter elements (160, 162), a funnel-shaped sheet guide assembly 230 is provided with respect to at least some of the slitter element pairs. The guide assembly 230 consists of an upper guide element 320 (See FIG. 3) and a lower guide element 322. The two guide elements 320, 322 include elongated upper and lower guide plates 330, 332 that form an open funnel mouth at their upstream end as shown, and taper to an extended, narrow guide surface that provides sufficient clearance for sheets within a desired range of thicknesses. The guide surface formed between the pair of upper and lower guide plates 330 and 332 has a length that is sufficient to ensure that the sheet remains positively engaged with the shear surface of an adjacent slitter element pair 160, 162. The guide plates 330 and 332 are mounted on a pair of respective upper and lower base blocks 340 and 342 that reside above and below the sheet path (the sheet path being defined by the guide surface between confronting guide plates 320, 322). The base blocks, in turn, ride laterally on an upper pair of rails 350, 360 (on each of assemblies 110, 120, respectively) and lower pair of rails 352, 362 (on each of assemblies 110, 120, respectively). These rails are mounted between respective assembly side plates 140, 142 and 144, 146 in this embodiment. The guide blocks 304, 342 move along these rails (which include a smooth and/or polished metal surface) with a snug engagement so that they experience predetermined friction with minimal play. In particular, a spring-loaded, adjustable brake assembly (not shown) can be employed to increase friction. The brake can be any conventional friction-causing mechanism (e.g. a metal ball and spring), and is contained in a well within the block 340, 342. The well defines an opening against one of the rails that allows the brake element to pressurably engage the rail. A movable screw cap 250 (See FIG. 2) at the top of upper block 340 and bottom of lower block 342 allows access to the brake mechanism and allows adjustment of the spring or other brake component. The brake component is optional in alternate embodiments.

In an embodiment, each block 340 includes at least one keyway (and illustratively a pair of side-by-side keyways) that are constructed and arranged to engage an upstream end of the respective key 194, 196 in each assembly 110, 120. Thus, when the forked portion of the key engages the slitter pair, the upstream edge of the key engages the 380 slot in an adjacent pair of confronting, upper and lower base blocks 340 and 342. In this manner, when the key assembly (190, 192) shuttles laterally to move the slitter element pair, it concurrently moves the base blocks 340, 342 and thus, it moves the overall associated guide assembly 230. Once the fork disengages and locks the slitter pair in place at the new location along the drive shaft, the guide assembly 230 remains at the new location along its rail pairs 350, 352 and 360, 362 based upon friction and the fact that there is little or no lateral force applied by the sheets or other system components during runtime operation. That is, the lateral force on the guide assembly through sheet movement, vibration, etc., is less than the frictional holding force of the guide assembly with respect to its rails.

In this embodiment, the rails are round min cross section, but in alternate embodiments they can have a regular or irregular polygonal cross section and/or a non-circular, curvilinear cross section. Likewise, while two rails are used in this embodiment to support each base block, in alternate embodiments, a single rail having, for example a non-circular or keyed cross section can be employed.

Figure 4:
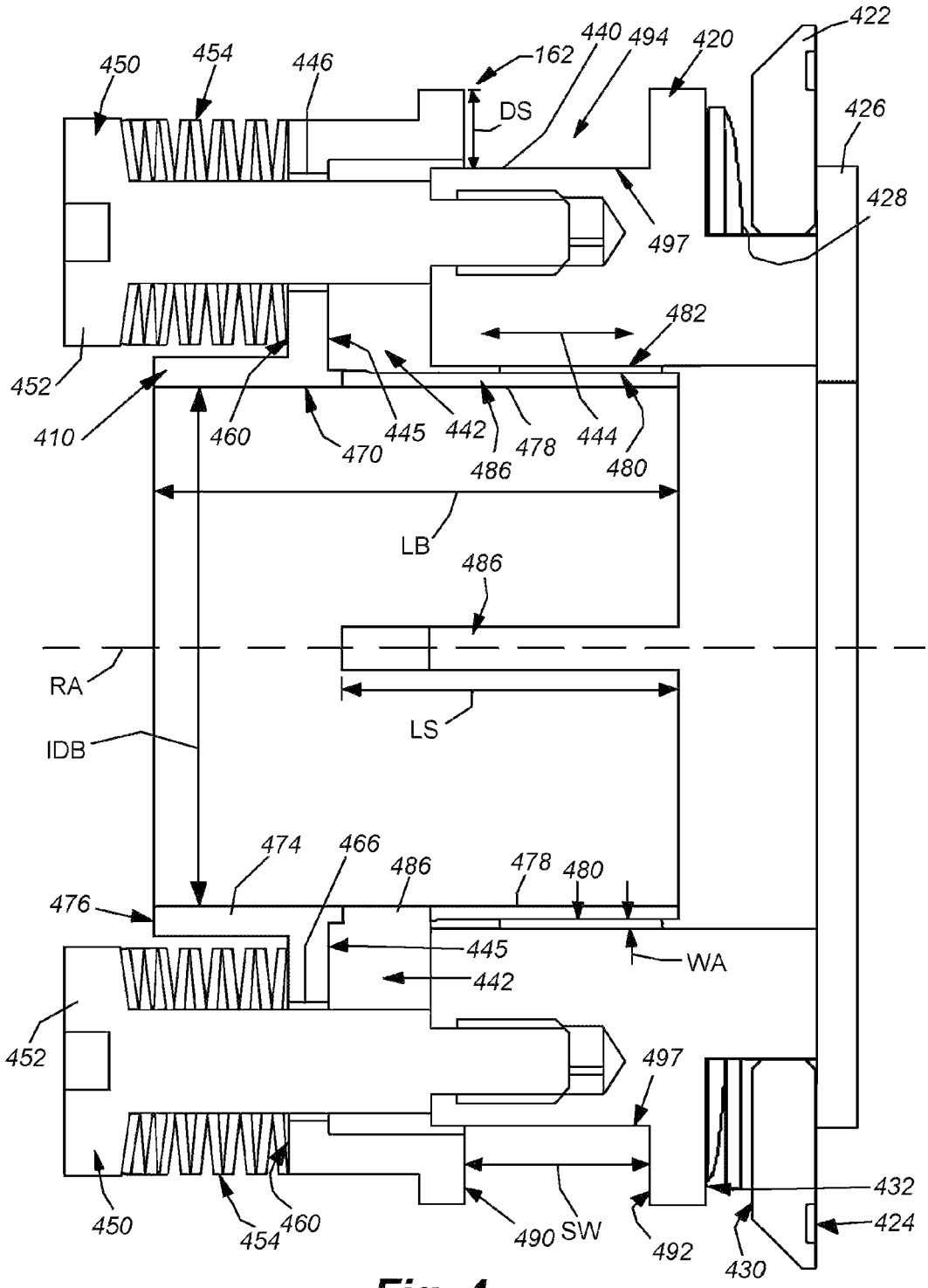
FIG. 4 is a side cross section of an illustrative slitter element for use with the illustrative slitter assemblies of FIG. 1.
Figure 5:
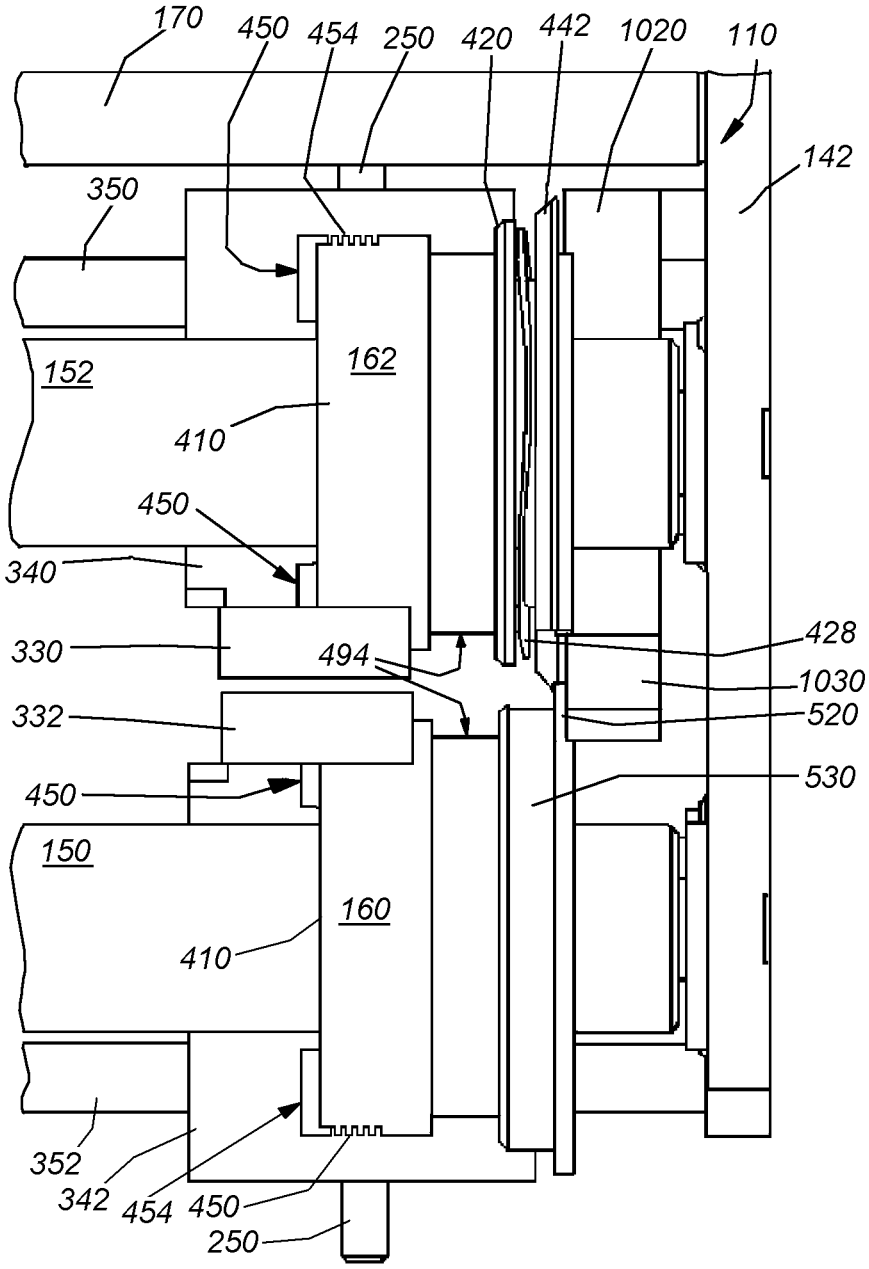
FIG. 5 is a fragmentary rear view of a pair of illustrative slitter elements in an impinging relationship and associated sheet guides for use with the illustrative slitter assemblies of FIG. 1.

With reference to FIG. 4, the locking structure of a slitter element is described in further detail. The depicted slitter element is an upper blade element 162 as shown in FIGS. 1-3. The internal construction of the locking mechanism from lower slitter elements 160 is essentially the same, and thus this description applies to both the upper and lower elements. Thus, where the components in each type of slitter element are similar, such components are provided with like reference numerals. As shown, the element 162 consists of two main concentric components, a base member 410 that seats on the drive shaft (not shown in this figure for clarity) and a coaxial blade-carrying member 420. The blade-carrying member 420 includes a hardened circular blade, which can be conventional in design at a front end opposite the base 410. As shown in the stacked slitter arrangement of FIG. 5, the blade 422 includes a forward cutting surface 424 that overlaps a raised surface 520 shear-carrying member 530 of the lower slitter element 160 to define the overall, impinging shear. The blade 422 is biased against an annular shoulder 426 by a flat spring 428 that resides between the blade's inner surface 430 and an opposing wall 432 on the member 420. This allows the blade to maintain a floating, pressurable contact against the lower slitter element's (160) shear surface and also to absorb (and counteract) axial displacement of the blade-carrying member 420 (described below). Note that the blade and member can be slidably (in an axial direction) keyed to each other in various embodiments so the blade does not freewheel when the member 420 rotates. Because the lower slitter element 160 includes a fixed rim, the key restrains this element before it engages the upper slitter element 162. Upon engaging the upper slitter element, the axial displacement of the wedge assembly requires that the blade move axially against the now-fixed rim or the upper wedge assembly would seize.

The blade-carrying member 420 also includes a barrel 440 that seats within an annular cup 442 in a manner that allows axial movement (double arrow 444, aligned with rotational axis RA). The rear (inner) wall 445 of the cup 442 includes two or more holes 446, 466 through which threaded fasteners 450 pass. The fasteners 450 are threadingly engaged with the blade-carrying member 420, and include opposing heads 452 that bear upon a coaxial spring assembly 454. The spring assembly 454 also bears upon the opposite (outer) wall 460 of the cup 442. The spring assembly 454 can be any acceptable biasing mechanism, For example, a plurality of stacked Bellville (cupped) spring washers can be employed as shown, or a conventional coil spring can be used. The overall biasing force should be sufficient to provide the required locking pressure to secure the slitter element to the drive shaft free of any rotational or axial movement when locked.

The locking force is provided by the selective interaction wedge arrangement between the base member 410 and the blade-carrying member 420. As shown, the base member 410 includes an inner surface 470 having an inner diameter IDB of approximately 0.75 inch, which conforms closely to the outer diameter of the drive shaft. The drive shaft and base 410 can be keyed, splined, polygonal or keyless (as shown), so long as the base is free to slide axially along the shaft when unlocked. If the shaft is keyed, splined or otherwise non-circular in cross section, the base includes a similar geometry along its inner surface. The shaft-engaging inner surface 470 is continuously cylindrical in the section 474 extending rearwardly approximately from the cup wall 445 to the rear end 476 of the base 410. The forward portion 478 of the base's inner surface 470 includes a wedge-shaped outer side 480 defining a wedge angle WA of between approximately 1 and 3 degrees in an embodiment. This surface is overridden by a corresponding wedge surface 482 on the inside of the blade-carrying member 420. Illustratively, the members 410 and 420 are constructed from steel alloy, and the thickness of the wedge-shape forward portion ranges from 0.010 to 0.002 inch. The wedge-shaped forward portion 478 of the base 410 is split at four (or more) diametrically evenly positioned splits 486 (e.g. at 90-degree separations around the circumference of the portion 478). These allow the divided segments of the wedge-shaped forward portion 478 to flex radially inwardly when the wedge is forced together under the action of the spring assemblies 454. This flexure is sufficient to provide a desired hoop stress to the drive shaft to effect positive locking of the base member 410 with respect to the drive shaft.

Note, as used herein, orientational terms such as "front", "rear", "top", "bottom", "inner", "outer", "vertical", "horizontal", and the like are meant only as relative conventions and (unless otherwise indicated) not as absolute indicators of direction with respect to the operation of gravity.

In a resting state, the slitter element is locked to the drive shaft by the action of the spring assemblies in conjunction with the wedge arrangement. The locking force is overcome by relieving the axial biasing force that drives the wedge faces 480, 482 together. This is accomplished, by directing the key between a pair of external, annular walls 490 and 492 that confront each other to from a slot 494. One wall 490 is formed on the base member 410 and the other, confronting wall 492 is formed of the blade-carrying member 420. The slot 494 defined between them has a radial depth DS of approximately 0.120 inch, and a resting axial width SW of approximately 0.250. These measurements, and others described above are highly variable in alternate embodiments, dependent in part upon the overall size of the slitter element and associated drive shaft. With reference to the illustrative key assembly 190 in FIG. 6, the key 194 has a span SK between tines 610 and 612 that is sized to allow it to slide into the slot 494. Thus SK is slightly greater than or approximately equal to the diameter of the inner surface 497 of the slot 494. Notably, the thickness TK of the main portion (remote from tips 620 of the key tines 610, 612) of each key tine 610, 612 is greater that the resting width SW of the slot 494. In an embodiment, the key tine thickness TK is approximately 0.280 inch. The tips 620 of the tines 610, 612 are tapered inwardly toward their respective ends to a minimum thickness TT of approximately 0.125 inch, which is sufficiently less than the slot width SW to ensure insertion of the keys without binding. In this manner, the key can move upwardly into engagement with the slot, and when the main (non-tapered) portion of the tine passes into the slot, it can cause the slitter element members 410 and 420 to move axially away from each other. The axial movement caused by entry of the key is sufficient to un-wedge the members 410, 420 and relieve the locking hoop stress on the drive shaft. This allows for unlocking and axial movement of the stacked pair of slitter elements as they are engaged by the key. In particular the slot, in this captures the key in this orientation, and any axial/lateral movement (double arrows 193, 195) along by the key assembly results in simultaneous movement of the engaged slitter elements along the drive shaft.

It should be clear that the use of a key with one or more times that are offset from the axis of the drive shaft and engage the periphery of the slitter elements allows the assembly to move freely along the vertically stacked drive shafts, while capturing the slitter element pair.

Figure 6:
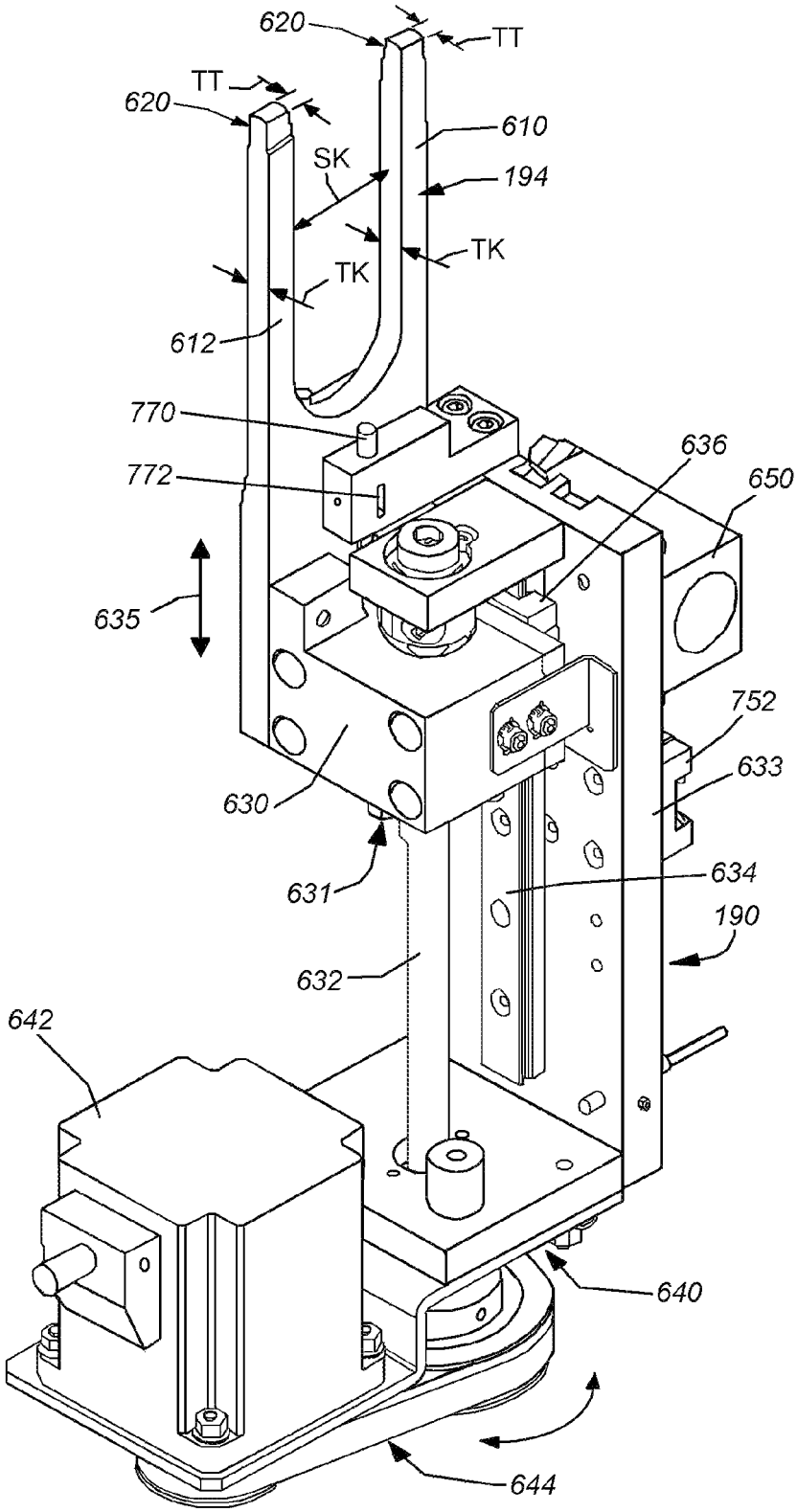
FIG. 6 is a perspective view of an illustrative moving key assembly and associated drive motor on a carriage for use with the illustrative slitter assemblies of FIG. 1.
Figure 7:
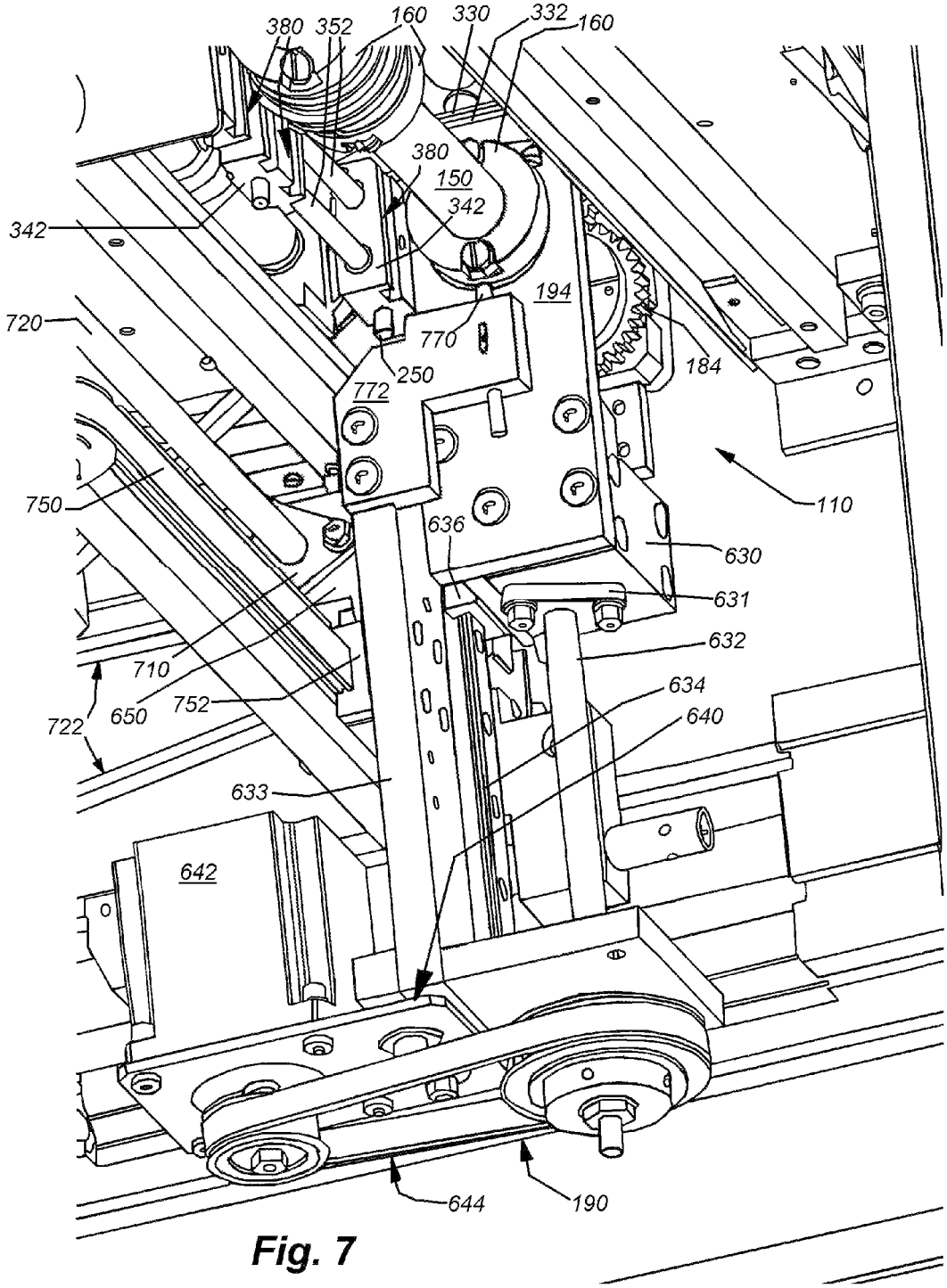
FIG. 7 is a fragmentary, bottom-oriented perspective view of the moving key assembly with associated drive motor and carriage shown in engagement with the pair of illustrative slitter elements of FIG. 4.

With further reference to FIGS. 6 and 7, the key assembly 190 is shown and described in further detail. The structure and function of the key assembly 192 should be considered similar or identical and like reference numerals refer to like components in both assemblies 190, 192. As shown, the key 194 is mounted on a base block 630. The base block 630 includes a threaded member 631 that rides on a screw shaft 632. The key assembly 190 includes a vertical support plate 633 having a vertical track 634. The track 634 guides a slider 636 that is mounted to the base block 630. This arrangement ensures that the base block 630 moves linearly (free of rotation relative to the vertical support plate 633) as it is selectively driven upwardly and downwardly (double arrow 635 by the screw 632. The vertical support plate 633 carries, at a bottom end, a motor mount 640, which includes a drive motor 642 and a timing belt assembly 644. The belt assembly 644 operatively interconnects the motor 642 with the base of the screw 632. The motor 642 can be any controllable drive, and the belt assembly 644 can be substituted for gears or another appropriate transmission mechanism in alternate embodiments.

The motor is controlled by a controller or control processor 370 (FIG. 3) that selectively raises and lowers the key by rotating the motor through a predetermined range of rotational motion. The motor can be a stepper motor, servo or other appropriate type. It can include an encoder to track relative motion. The motor can optionally be interconnected with limit switches (not shown) that stop movement of the mechanism at the top and/or bottom ranges of vertical key motion.

The vertical support plate 633 also includes a block 650 having a threaded member 710 (FIG. 7) that rides upon a horizontal lead screw 720. The lead screw 720 is rotated in each of opposing directions by a separate drive motor (not shown) and drive belt assembly 722, which receives signals from the controller. The motor, which can be a stepper, servo, or other type having an optional encoder to track movement, operates to move the key assembly 190 in a widthwise (lateral) direction to various points along the slitter assembly (110). A track 750 is mounted laterally on the slitter assembly frame, and guides a slider 752. The slider 752 is fixed to the vertical support plate 633 beneath the thread block 650. This track and slider arrangement 750, 752 maintains a lateral movement and prevents rotation of the key assembly when the lead screw 720 rotates. The motor is controlled by the controller to move a predetermined distance based upon a number of steps or encoder pulses relative to the previous position. The controller tracks the location of each slitter element pair along the shaft (i.e. the location of the slots 494 for the pair), with respect to the assembly's key. This tracking can use conventional techniques, such as those used form moving and tracking the motion of robotic components along an axis. The controller initially establishes a base position for each slitter element. This can be accomplished using an optical sensor or by a manual mechanism. For example, as shown in FIG. 7, an optical sensor 770 can be attached by a bracket 772 in the vertical support plate 633 of the key assembly 190 so that it faces each lower slitter hub 160. An optical reflection from the hub's 160 blade edge instructs the controller (which is operatively connected to the sensor 770) that the key assembly carriage (and associated key) is aligned with a given hub. By initially passing laterally over all hubs, the controller can determine a relative position for each one. That is, the detection of each hub is correlated with a discrete encoder signal (e.g. pulse count) associated with the key assembly horizontal screw drive 720. The controller stores these positions, and when a hub is to be moved to a new location, the controller directs the carriage to align with that hub based upon the stored controller position signals.

Once the locations of the slitter elements is established and stored, the assembly can shuttle between them under the drive of the horizontal screw 720, and engage and disengage each one using the vertical drive screw 632. The controller tracks and stores any new locations (e.g. pulse counts from a stored encoder reference point/baseline) for each hub. The controller logic is constructed and arranged so that the slitter elements are engaged and moved along the drive shafts by the key assembly in an order that avoids collisions with other slitter elements. Conventional decision algorithms can be used to control this motion sequence based upon the stored knowledge of the current positions of each of the slitter elements. Some slitter elements are potentially unused in certain jobs. These are moved sufficiently to the sides of the assembly to be free of interference with the paper/sheet path.

Figure 8:
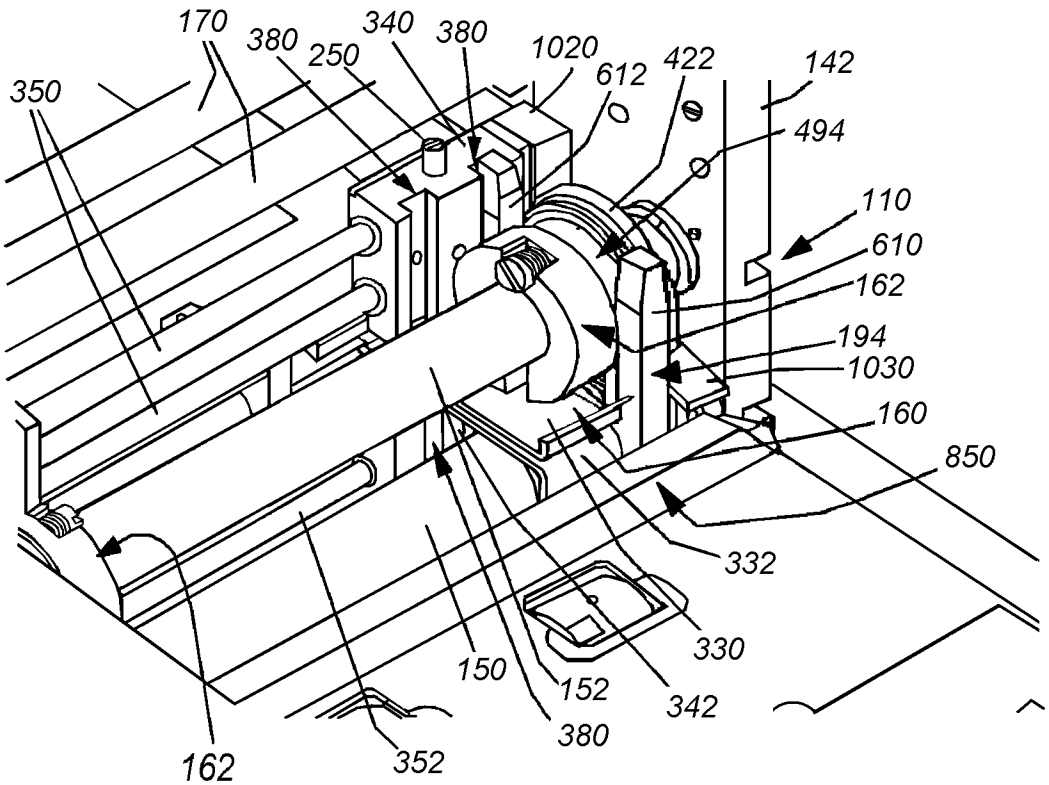
FIG. 8 is a fragmentary, top-oriented perspective view of the pair of illustrative slitter elements and the engaged key assembly of FIG. 7.
Figure 9:
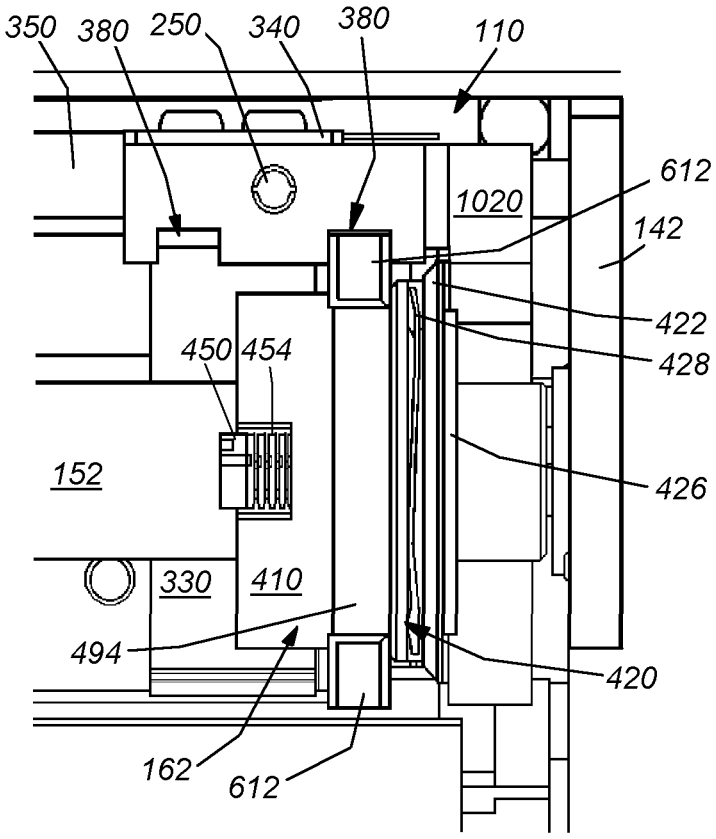
FIG. 9 is a top view of the pair of illustrative slitter elements and the engaged key assembly of FIG. 7.

With further reference to FIGS. 8 and 9, the key 194 engages a pair of slitter elements 160 and 162 that are adjacent to the side plate 142. The tines 610 and 612 of the key 194 engage the slot 494 and cause the members 410 and 420 to spread apart against the biasing force of the spring assemblies 454. Concurrently, the upstream edge of the tine 612 engages one of the grooves 380 in the guide-carrying block 340. When the engaged key assembly 190 moves laterally along the drive shafts 150 and 152, it carries the respective slitter elements 160 and 162, and the block 340.

Figure 10:
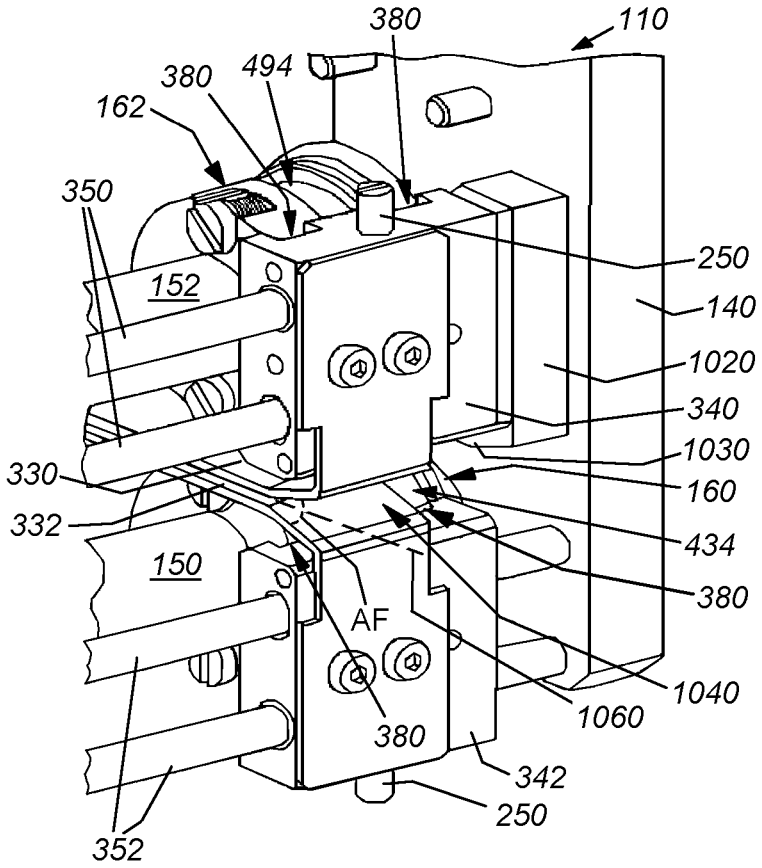
FIG. 10 is a fragmentary front-oriented perspective view of a pair of illustrative slitter elements for using the slitter assemblies of FIG. 1 showing the sheet guides, blocks and associated guide rails therefor, in addition to a gutter strip diverting guide.
Figure 11:
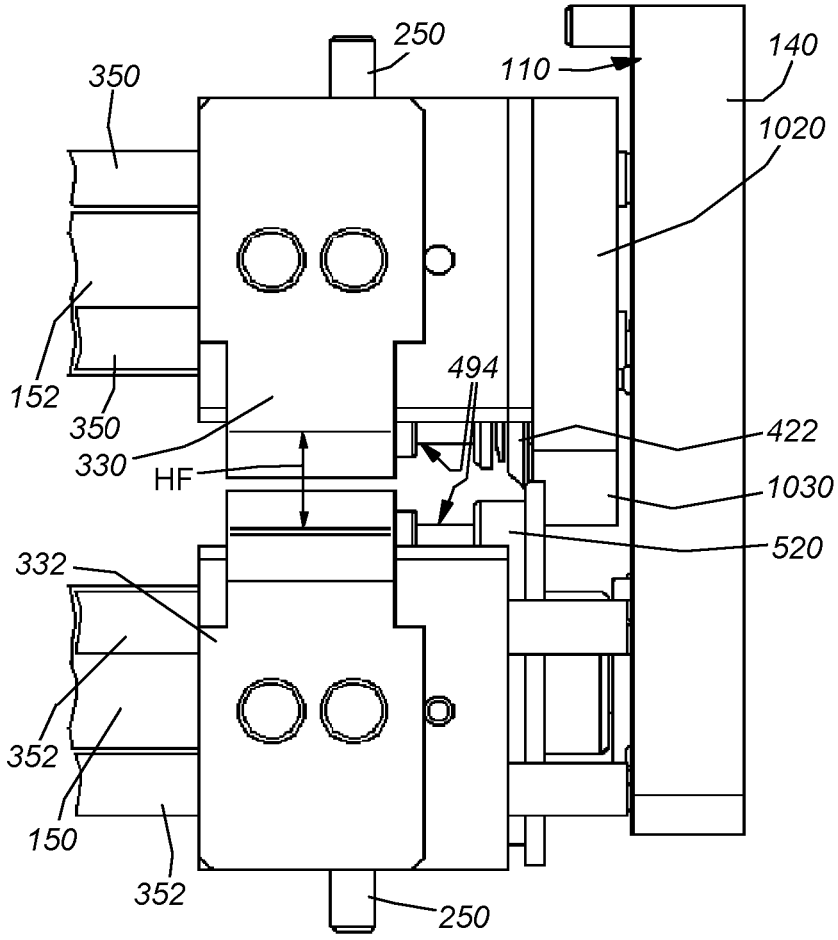
FIG. 11 a fragmentary front view of a pair of illustrative slitter elements, sheet guides, blocks and associated guide rails of FIG. 11.

With further reference to FIGS. 10 and 11, the upstream side of the assembly 110 is depicted with reference to the side plate 140. A slitter element pair 160, 162 is depicted adjacent to the side plate 140, thereby defining a widthwise edge of the cut sheet. Where the input sheet is wider than the slitter element placement, the slitter elements will trim a gutter strip from the edge. To avoid clogging of the device, the upper block 340 includes an extension base 1020 that can be attached using clips, fasteners, or the like. This base 1020 carries a downwardly directed deflector 1030, which diverts the trimmed gutter strip beneath the adjacent feed surface 850 (see FIG. 8). Illustratively, the deflector is constructed and arranged to overlie the trimmed strip and engage the strip's top surface. The downwardly directed angle of the deflector plate (along the downstream direction) ensures that the strip follows a downward path, out of the plane of the feed path (i.e. below the feed plane defined between the guide plates. A waste bin (not shown), or other removal arrangement (e.g. a vacuum collection system), receives and stores the trimmed sheet material. The base 1020 and deflector 1030 are provided to blocks 340 that are adjacent to the opposing ends of the slitter assembly. These blocks are positioned according to the desired overall width of the slit sheet(s) passing through the assembly, and thus the deflectors are permanently attached to the opposing outboard edges of each block. The deflectors are adapted to move with the block as it (and the slitter element pair) is repositioned laterally along the assembly. In alternate embodiments, the deflector assemblies can remain free-floating with respect to the rails 350, moved by a separate mechanism, or be omitted. Likewise, when not in use, the deflector assembly(ies) can be removed from their underlying blocks 340.

With reference particularly to FIG. 10, the funnel-shaped opening 1040 between guide plates is more-clearly depicted. The angle AF of each of the guide plates 330, 332 with respect to line 1060 (which resides generally in the feed path's plane) is highly variable. In an embodiment, the angle AF is between approximately 3 and 10 degrees. Likewise the funnel angle AF of each confronting guide plate 330, 332 can differ with respect to the other. The overall height HF (FIG. 11) at the opening is also highly variable. In an embodiment, the funnel height HF is sufficient to endure sheets of varying thicknesses are guided into the feed plane in the region of the slitter elements. In an embodiment, the height HF can be between approximately ⅜ and ¾ inch.

Figure 12:
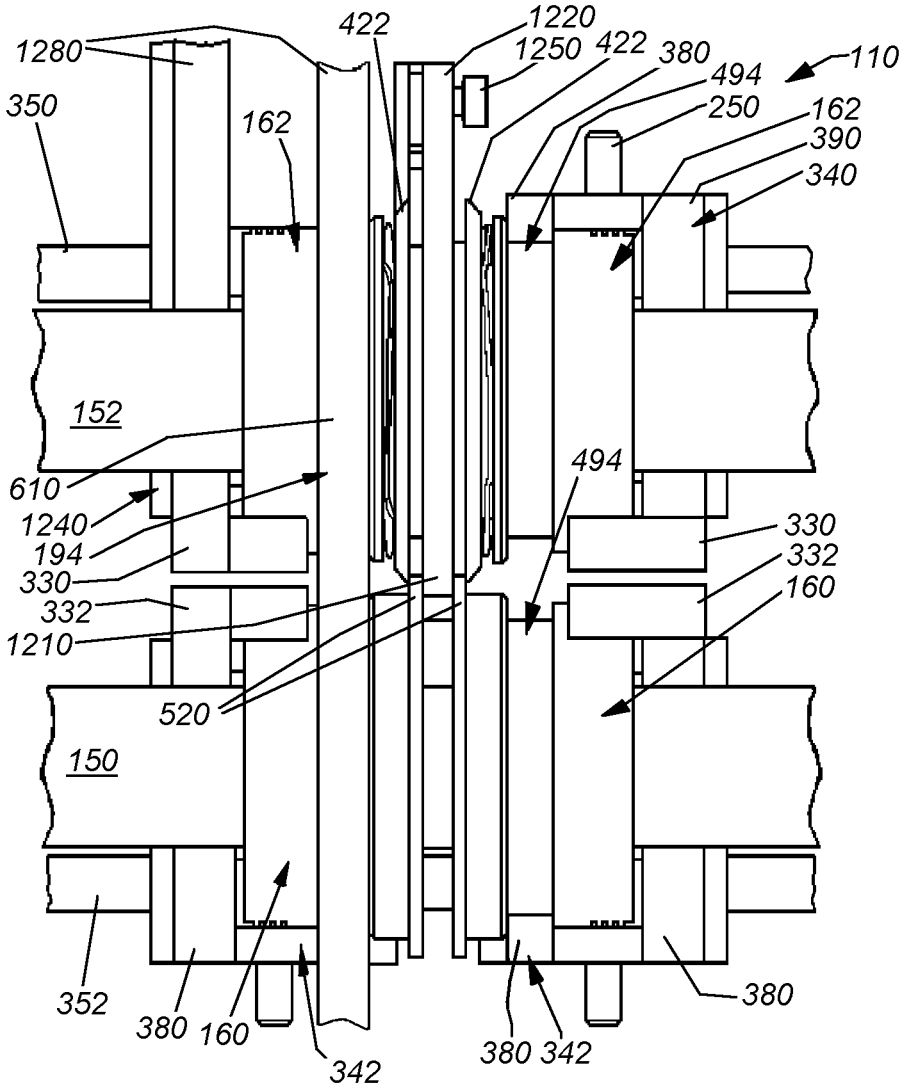
FIG. 12 is a fragmentary rear view of two sets of slitter elements of the upstream slitter assembly of FIG. 1 located in an adjacent orientation to provide a gutter strip between slit sheets and showing one of the slitter elements sets engaged by the moving key.

With reference now to FIG. 12, showing two slitter pairs 160, 162 in a relatively close, confronting arrangement along the mid region of the respective drive shafts 150, 152. This arrangement represents a slitter configuration located along the interior of a fed sheet, adapted to divide the single fed sheet into a plurality of side-by side exiting sheets. In this embodiment, the slit edge of each side-by-side sheet is cleanly defined by generating a central gutter strip between them. The gutter strip is directed downwardly to a waste location (described above) using a narrow deflector plate 1210 attached to a removable base 1220. The base 1220 is likewise attached to a block 1240 having an extended height to accommodate the base 1220. The base is attached by one or more fasteners 1250, or by another attachment mechanism that allows for removability. As shown the key 194 engages the right (taken in a downstream direction, opposite the viewing direction) slitter element pair 160, 162 and block 1240. The use of ambidextrous slots 380, 1280 allows the key to engage each block 340, 1240 along a side of the block opposite to the side that carries the guide plate (330, 332). This allows for manufacture of a single block for both right and left guide plate placement. In the depicted example, the key 194 engages the leftmost slot (1280) of the right block 1240 and the rightmost slot (380) of the left block 340. In alternate embodiments, a single groove can be provided to some or all blocks.

It should be clear that the above-described slitter assembly provides a versatile an effective mechanism for automatically and rapidly adjusting the slitter elements to accommodate a given sheet size. The mechanism allows for size adjustments during normal runtime and rapid change-out of slitter configurations based upon the novel cartridge configuration of the slitter assembly. This assembly can be adapted to a wide range of sheet feeding and handling devices.

The foregoing has been a detailed description of illustrative embodiments of the invention. Various modifications and additions can be made without departing from the spirit and scope of this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, in an alternate embodiment, a key having a single tine can be employed. This tine can be located between the guide-carrying block and slitter element slot in an embodiment. Likewise, while the impinging slitter elements and respective drive shafts are stacked in a vertical orientation, it is expressly contemplated that the axes of the respective slitter elements/drive shafts can be aligned non-vertically, and the key assembly can be oriented to insert and remove the key in a direction generally parallel to the orientation of the axes. Assemblies that travel non-linear paths to direct a key into engagement with slitter elements and/or the guides can also be provided. Likewise, separate assemblies can be used to lock/unlock and move the slitter elements and/or the guides. In another alternate embodiment, one of the stacked slitter elements is lockable and captures the other slitter element using, for example using a pair of axially spaced rims that laterally capture the opposing blade or raised annular surface. In such an embodiment, the captured element is generally freely slidable when the lockable slitter element slides laterally along the drive shaft. The freely sliding, captured element can be rotationally fixed using a spline arrangement, keyway or the like. Also, in another alternate embodiment, the sheet guide assembly can be mounted with respect to the drive shaft(s) and slitter elements so that movement of the slitter elements causes the guide assembly to move laterally based directly upon lateral implement of the slitter elements. Accordingly, this description is meant to be taken only by way of example, and not to otherwise limit the scope of this invention.

What is claimed is:

1. A sheet slitting mechanism comprising:

a framework having sides that support a first drive shaft and a second drive shaft, each having a respective rotational axis, wherein each axis is substantially parallel to the other axis;

a first slitter element mounted on the first drive shaft and including an axially movable first wedge assembly that is normally biased into an axially locked position on the first drive shaft;

a second slitter element mounted on the second drive shaft that impinges to first slitter element to form a shear; and a key assembly constructed and arranged to selectively engage the first slitter element to axially move the first wedge assembly into an axially unlocked position, the key assembly being movable in the axial direction to move each of the first slitter element axially along the first drive shaft and the second slitter element axially along the second drive shaft;

wherein the second slitter element includes an axially movable second wedge assembly that is normally biased into an axially locked position on the second drive shaft and the key assembly is further constructed and arranged to selectively engage the second slitter element to axially move the second wedge assembly into an axially unlocked position;

wherein the first wedge assembly and the second wedge assembly each define a shoulder of a circumferential groove and the key assembly includes a key having at least one tine with a tapered tip that moves into the groove to thereby axially spread-apart the groove.

2. The sheet slitting mechanism as set forth in claim 1 further comprising a sheet guide assembly that maintains sheets within a feed path plane, the sheet guide assembly being located adjacent to the first slitter element and the second slitter element and being selectively engaged by the key when the tine of the key moves into the groove so that the guide assembly is movable axially in conjunction with axial movement of the first slitter element and the second slitter element by the key assembly.

3. The sheet slitting mechanism as set forth in claim 2 wherein the sheet guide assembly comprises a first guide and a second guide, each including confronting guide surfaces having a space therebetween through which sheets pass.

4. The sheet slitting mechanism as set forth in claim 3 wherein each of the first guide and the second guide include a base that is movable in the axial direction along a rail assembly, the first sheet guide assembly includes a first guide base that moves in the axial direction along a first rail assembly and the second sheet guide assembly includes a second guide base that moves in the axial direction along a second rail assembly, each of the first guide base and the second guide base including a slot that captures a portion of the tine of the key when the tine of the key moves into the groove.

5. The sheet slitting mechanism as set forth in claim 3 wherein the at least one of the first guide and the second guide include a base that moves in the axial direction and having attached thereto a deflector that guides waste trimmings into a waste location.

6. The sheet slitting mechanism as set forth in claim 1 wherein the key assembly includes a lead screw drive that moves the key between an engaged and a disengaged position with respect to the first wedge assembly.

7. The sheet slitting mechanism as set forth in claim 1 further comprising a lead screw drive that moves the key assembly in the axial direction to a selected location.

8. The sheet slitting mechanism as set forth in claim 1 further comprising a third slitter element mounted on the first drive shaft and including an axially movable third wedge assembly that is normally biased into an axially locked position on the first drive shaft and a fourth slitter element mounted on the second drive shaft that impinges to third slitter element to form a shear, and a controller that selectively drives the key assembly to selectively engage either of (a) the first slitter element or (b) the third slitter element to unlock and axially move either of (a) the first slitter element axially along the first drive shaft and the second slitter element axially along the second drive shaft or (b) the third slitter element axially along the first drive shaft and the fourth slitter element axially along the second drive shaft, respectively.

9. The sheet slitting mechanism as set forth in claim 8 wherein the first slitter element and the third slitter element are located adjacent to each other so as to define a slit gutter strip in a sheet passing therethrough.

10. The sheet slitting mechanism as set forth in claim 1 wherein the first slitter element includes a blade biased into a resting position against a rim on the second slitter element, the blade being movable axially when the first wedge assembly is engaged by the key assembly.

11. The sheet slitting mechanism as set forth in claim 1 further comprising a hub sensor operatively connected with a controller that detects and stores a location data value with respect to a position of at least one of (a) the first slitter element along the first drive shaft and (b) the second slitter element along the second drive shaft with respect to a reference location.

12. The sheet slitting element as set forth in claim 11 wherein the controller is constructed and arranged to store a new location data value of a new position of at least one of (a) the first slitter element along the first drive shaft and (b) the second slitter element along the second drive shaft with respect to a reference location after the key assembly has moved at least one of (a) the first slitter element along the first drive shaft and (b) the second slitter element along the second drive shaft.

* * * * *